US011083307B1

(12) United States Patent
Anderson et al.

(10) Patent No.: US 11,083,307 B1
(45) Date of Patent: Aug. 10, 2021

(54) PLUSH BEDROOM CLIP

(71) Applicants: Adam R Anderson, Monroeville, PA (US); Kyle Compton, Girard, KS (US); Seth Bohlken, Arma, KS (US)

(72) Inventors: Adam R Anderson, Monroeville, PA (US); Kyle Compton, Girard, KS (US); Seth Bohlken, Arma, KS (US)

( * ) Notice: Subject to any disclaimer, the term of this patent is extended or adjusted under 35 U.S.C. 154(b) by 0 days.

(21) Appl. No.: 16/779,606

(22) Filed: Feb. 2, 2020

Related U.S. Application Data

(60) Provisional application No. 62/835,199, filed on Apr. 17, 2019, provisional application No. 62/800,598, filed on Feb. 4, 2019.

(51) Int. Cl.
*A47C 21/02* (2006.01)
*A44B 99/00* (2010.01)

(52) U.S. Cl.
CPC ..... *A47C 21/022* (2013.01); *A44B 99/00* (2013.01); *A47C 21/028* (2013.01); *A44D 2203/00* (2013.01)

(58) Field of Classification Search
CPC ..... A44D 2203/00; A47C 21/022; A47C 21/028; A44B 99/00; Y10T 24/23; Y10T 24/32; Y10T 24/44291; Y10T 24/44376; Y10T 24/44385; Y10T 24/44462; Y10T 24/4447
See application file for complete search history.

(56) References Cited

U.S. PATENT DOCUMENTS

| | | | | |
|---|---|---|---|---|
| 2,022,169 | A | 11/1935 | Matsukichi et al. | |
| 2,988,759 | A | 6/1961 | Gerdes | |
| 3,529,328 | A * | 9/1970 | Davison | A47G 25/485 24/303 |
| 5,400,478 | A | 3/1995 | Levinsohn et al. | |
| 5,404,602 | A | 4/1995 | Kondo | |
| 7,356,889 | B2 | 4/2008 | Alitowski | |
| 8,689,375 | B2 | 4/2014 | Stinchcomb | |
| 8,745,787 | B1 | 6/2014 | Heimlich | |
| 2002/0073516 | A1* | 6/2002 | Behar | A47B 21/06 24/306 |
| 2005/0023420 | A1* | 2/2005 | Sadeh | B42F 11/04 248/206.5 |
| 2006/0282993 | A1* | 12/2006 | Dietz | A45F 5/02 24/303 |
| 2008/0104742 | A1* | 5/2008 | Alperin | A41F 17/02 2/321 |
| 2008/0104751 | A1 | 5/2008 | Friedland | |

(Continued)

*Primary Examiner* — Robert Sandy
(74) *Attorney, Agent, or Firm* — Thomas M. Joseph, Esq

(57) ABSTRACT

A clamp is provided. The clamp has a first member, a second member, and a biasing element assembly pivotally connecting the first member to the second member. A first end of the first member can be pivoted to a position that is essentially adjacent to a second end of the second member and locked into place. A first slot is formed on a first surface of a first cushion. A second slot is formed on the second surface of a second cushion. A first member of a clamp is inserted into the first slot and a second member of the clamp into the second slot, so that a portion of at least one layer of bed covering materials can be positioned between the clamp first member and the clamp second member when the first member is locked into place.

20 Claims, 8 Drawing Sheets

(56) References Cited

U.S. PATENT DOCUMENTS

| | | | | |
|---|---|---|---|---|
| 2009/0283197 | A1* | 11/2009 | Gorodisher | B65D 33/1658 156/60 |
| 2010/0083699 | A1* | 4/2010 | Conigliaro | A44C 15/003 63/1.18 |
| 2019/0350318 | A1* | 11/2019 | Levine | A44B 99/00 |

* cited by examiner

PLUSH BEDROOM CLIP

CROSS REFERENCE TO RELATED APPLICATION

This application claims the benefit under 35 U.S.C. § 119(e) of U.S. Provisional Application No. 62/800,598 entitled "PLUSH BEDROOM CLIP" filed Feb. 4, 2019, and U.S. Provisional Application No. 62/835,199 entitled "PLUSH BEDROOM CLIP" filed Apr. 17, 2019, which are incorporated herein by reference.

BACKGROUND

Most people cover a bed with an assortment of bedding cover materials to keep the mattress of the bed relatively clean and like to enclose and protect other bedding materials. Bedding cover materials can include sheets, such as under-sheets and over sheets, or other items, such as quilts, blankets, comforters, duvets and the like. Typically, bedding cover material is formed of two rectangular sheets formed of a conventional textile sheeting material such as woven cotton, linen, synthetic fibers and combinations thereof. This sheet material is sewn into a rectangular bag closed along three sides and open at one end. Filler material can be placed within the bag to add insulation to the bedding cover material.

Depending upon the sleeping environment, it can become necessary to position multiple layers of bedding cover materials on a bed. However, to neatly make up a bed, a person might need to remove one or more of the layers and reposition them on the bed.

During the bed-making process, a sheet can be placed neatly on the bed and possibly tucked in between the mattress and the support for the mattress, e.g., the box spring, platform, floor, etc., to provide a neat, smooth placement on top of the under-sheet and mattress. Thereafter, a comforter can be placed on top of the sheet and is arranged neatly. Other bedding cover materials can be added as necessary.

These tasks take time. Often people do not take the time to neatly make up a bed in view of rushed circumstances, e.g., late for work, late for school, etc. If the bed is not neatly made up, one might encounter an embarrassing situation if guests were to notice the unmade bed and sometimes a child who has not made up his or her bed, might encounter the anger of a parent. Accordingly, there is a need for items that can reduce the amount of time that it takes to perform these tasks.

Moreover, problems can arise in positioning bedding cover materials over the bed, or over other bedding materials, because the materials can be misaligned when a person gets into the bed. These problems multiply when a person that is sleeping in the bed tosses and turns during the night. For these reasons, there is a need for improved devices that can keep a bed and/or a bedroom neat in an efficient manner.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a clamp includes a first member having a first gripping region and a first handle region, a second member having a second gripping region and a second handle region, and a biasing element to bias the first gripping region of the first member against the second gripping region of the second member to lock the first member against the second member. A first cushion has an upper surface and a lower surface with the lower surface having a first slot therein. The first member first gripping region inserts into the first slot to connect the first cushion to the clamp.

In other implementations, a clamp is provided. The clamp has a first member, a second member, and a biasing element assembly pivotally connecting the first member to the second member. A first end of the first member can be pivoted to a position that is essentially adjacent to a second end of the second member and locked into place. A first slot is formed on a first surface of a first cushion. A second slot is formed on a second surface of a second cushion. A first member of a clamp is inserted into the first slot and a second member of the clamp into the second slot, so that a portion of at least one layer of bed covering materials can be positioned between the clamp first member and the clamp second member when the first member is locked into place.

In yet other implementations, a kit for clipping layers of bed covering materials includes a plurality of bedroom clips with each clip including a clamp having a first member, a second member, and a biasing element pivotally connecting the first member to the second member and locking the first member against the second member to grip the layers of bed covering materials, a first cushion for enclosing the first member, at least partially, and a second cushion for enclosing the second member, at least partially. The kit also includes a plurality of straps for connecting the plurality of bedroom clips to one another.

In other implementations, a plush bedroom clip includes a pair of flexible covers. An essentially flat, flexible member is positioned between the pair of flexible covers having a pair of spaced-apart bores with the pair of flexible covers essentially enclosing the essentially flat, flexible member. A magnet is positioned in one of the pair of spaced-apart bores. A magnetizable material is positioned in the other one of the pair of spaced-apart bores. The essentially flat, flexible member is movable from an essentially flat configuration to an essentially U-shaped, folded configuration with the magnet attracting the magnetizable material to form a clamp.

These, and other features and advantages, will be apparent from a reading of the following detailed description and a review of the appended drawings. It is to be understood that the foregoing summary, the following detailed description and the appended drawings are explanatory only, and are not restrictive of various aspects as claimed.

DETAILED DESCRIPTION

Figure 1:
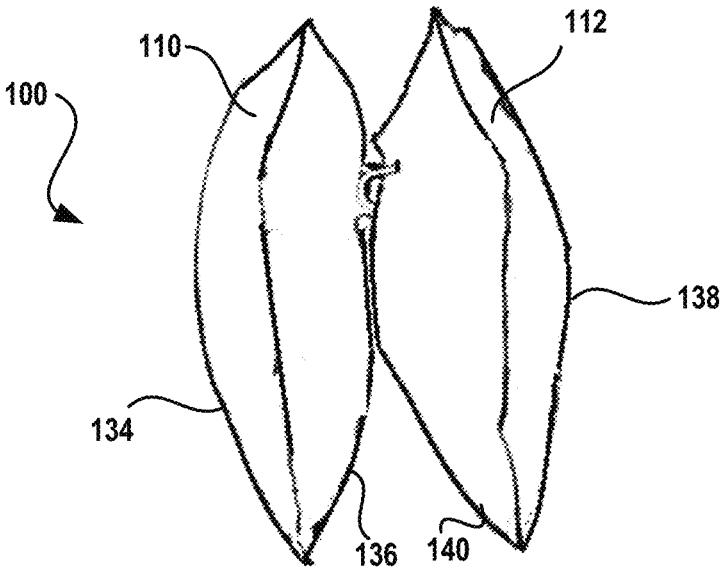
FIG. 1 is a perspective view of a plush bedroom clip in accordance with this disclosure.

The subject disclosure is directed to a plush bedroom clip. More specifically, the subject disclosure is directed to plush bedroom clip for gripping and holding a plurality of layers of bedding cover materials that includes a pair of cushions. The cushions are connected by an A-shaped spring clamp that includes a pair of members connected by a biasing element assembly. Each member is positioned within one of the cushions, so that the cushions are stacked in an essentially overlaying relation when the clamp grips and holds the layers of bedding cover materials.

The plush bedroom clips can be sold individually or in a kit containing a plurality of clips. The clips can be configured in various arrangements to hold bedding cover materials on a bed, or to facilitate bundling the bedding cover materials when they are removed from the bed. The plush bedroom clips are particularly adapted to hold bedding cover materials in place on a bed when a person is tossing and turning under the bedding cover materials.

The detailed description provided below in connection with the appended drawings is intended as a description of examples and is not intended to represent the only forms in which the present examples can be constructed or utilized. The description sets forth functions of the examples, and sequences of steps for constructing and operating the examples. However, the same, or equivalent, functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic; but every embodiment, implementation or example need not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples, whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

The plush bedroom clips include two small cushions that form cushion rubber clips that are held together with a hinge-like clamp. The clamp pivots the cushions toward one another and engage a plurality of layers of bedding cover materials. The clip can hold together multiple layers of bedding cover materials to prevent them from become tangled and to make it easier to make the bed. The plush bedroom clips can make it easier to prepare the layer of bedding cover materials for washing.

Figure 2:
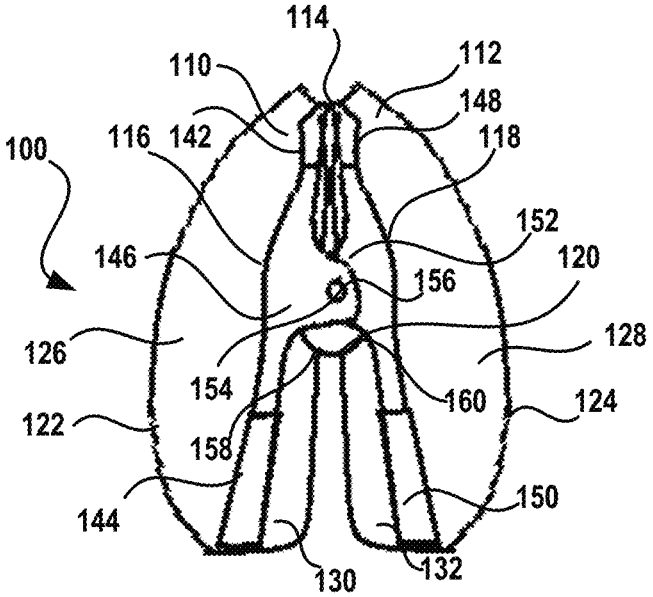
FIG. 2 is a side elevation view of a cross section of the plush bedroom clip shown in FIG. 1 in accordance with this disclosure.

Referring now to FIGS. 1-2, there is shown a plush bedroom clip, generally designated by the numeral 100, which is particularly adapted to grip and to hold a plurality of layers of bedding cover materials (not shown). The plush bedroom clip 100 includes a pair of plush cushions 110, 112 that are connected by a clamping device 114 that includes a pair of members 116, 118 connected to a biasing element assembly 120.

Each plush cushion 110, 112 includes an outer layer 122, 124 and an interior 126, 128 defining cavities 130, 132. The outer layer 122, 124 is formed from a plush flexible fabric material that can shaped into various geometric shapes or configurations. The outer layer 122 can define an upper surface 134 and a lower surface 136 with the terms "upper" and "lower" being arbitrarily defined relative to one another. Similarly, the outer layer 124 defines an upper surface 138 and a lower surface 140. The interiors 126, 128 can be filled with fabric or other filler material.

The first member 116 includes a first gripping region 142, a first handle region 144, and a first flange 146 connecting the first gripping region 142 to the first handle region 144. The second member 118 includes a second gripping region 148, a second handle region 150, and a second flange 152 connecting the second gripping region 148 to the second handle region 150.

The first flange 146 includes a hole 154 that receives a pin 156. The pin 156 can be inserted into the hole 154 to connect the first and second members 116, 118 to one another and to the biasing element assembly 120 in a pivotal manner. The biasing element 120 assembly can bias the first gripping region 142 against the second gripping region 148 to lock the first member 116 against the second member 118.

The first plush cushion 110 includes a first slot 158 for receiving the first member 116. The first gripping region 142 can be inserted into the first slot 158 to connect the first plush cushion 110 to the clamping device 114. The first handle region 144 can be inserted into the first slot 158 to position the first member 116 within the first cavity 130 within the first interior 126 within the first plush cushion 110.

The second plush cushion 112 includes a second slot 160 for receiving the second member 118. The second gripping region 148 can be inserted into the second slot 160 to connect the second plush cushion 112 to the clamping device 114. The second handle region 150 can be inserted into the second slot 160 to position the second member 118 within the second cavity 132 within the second interior 128 within the second plush cushion 112.

The plush cushions 110, 112 are plush objects that can be made of any suitable material using any suitable manufacturing or assembling process. In this exemplary embodiment, the plush cushions 110, 112 are made from rubber, textiles, or a combination of both. In some embodiments, the plush cushions 110, 112 are made from materials having predetermined colors, textures, etc. that match the aesthetics of the bedding cover materials while securing the materials. The aesthetics of the plush cushions 110, 112 maintain comfortability for the user in the event that they roll over on the plush bedroom clip 100 or otherwise contact the plush bedroom clip 100 during sleep.

The plush cushions 110, 112 can include flexible material on the outside rendering each plush cushion 110, 112 foldable, collapsible, or otherwise malleable. In one embodiment, the inside contents of the plush cushions 110, 112 can include a resiliently compressible synthetic foam filler material inserted in an envelope made of airtight, pliable sheet material.

The members 116, 118 and the biasing element assembly 120 can be arranged to form an A-shape. The biasing element assembly 120 can include one or more springs. In some embodiments, the first slot 158 can be sewn shut around the first member 116 and the second slot 160 can be sewn shut around the second member 118.

The clamping device 114 and, in particular, the members 116-118 can be made from any suitable materials, including metals, ceramics, polymers, plastics, or composites, through any suitable manufacturing process. In this exemplary embodiment, the clamping device 114 is made from metal.

Figure 3:
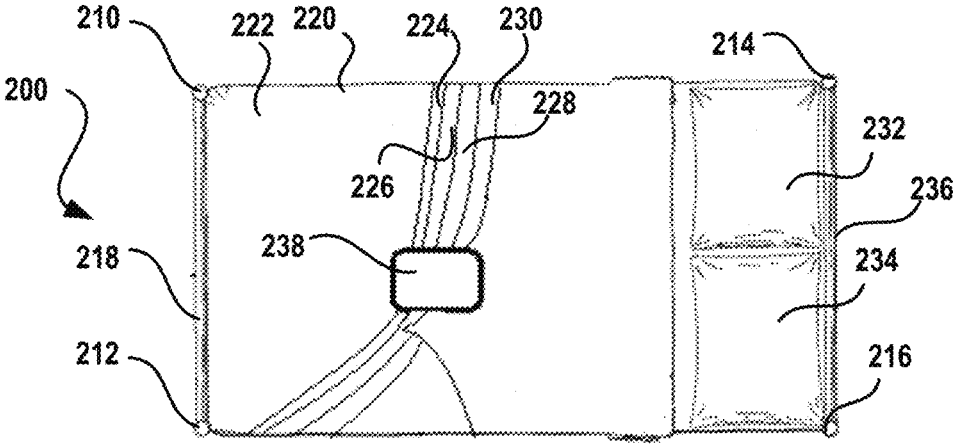
FIG. 3 is a top plan view of a plush bedroom clip positioned on top of a bed in accordance with this disclosure.

Referring to FIG. 3 with continuing reference to the foregoing figures, a bed, generally designated with the numeral 200, is shown. The bed 200 includes a plurality of bedposts 210-216 defining a bed frame 218 and an upper surface 220. The upper surface 220 is covered with multiple layers 222-230 of bedding cover materials. A pair of pillows 232, 234 are positioned adjacent to a headboard 236. A plush bedroom clip 238 holds the layers 222-230 in place. The plush bedroom clip 238 is essentially identical to the plush bedroom clip 100 shown in FIGS. 1-2.

Figure 4:
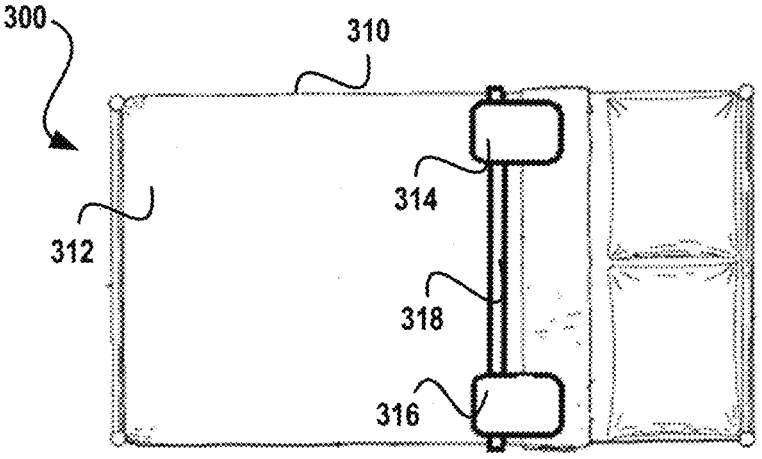
FIG. 4 is a top plan view of a plush bedroom clip kit positioned on top of a bed in accordance with this disclosure.

Referring to FIG. 4 with continuing reference to the foregoing figures, a bed, generally designated with the numeral 300 is shown. The bed 300 is essentially identical to the bed 200 shown in FIG. 3. An upper surface 310 of a plurality of bedding cover materials 312. The bedding cover materials 312 can include multiple layers, like the multiple layers 222-230 of bedding cover materials shown in FIG. 3.

Unlike the embodiment shown in FIG. 3, a pair of plush bedroom clips 314, 316 hold the bedding cover materials 312 in place. The plush bedroom clips 314, 316 can be essentially identical to the plush bedroom clip 100 shown in FIGS. 1-2 or the plush bedroom clip 238 shown in FIG. 3. The plush bedroom clips 314-316 can be connected to one another with a strap 318. The plush bedroom clips 314-316 and the strap 318 can be packaged together in a kit or can be sold separately.

Figure 5:
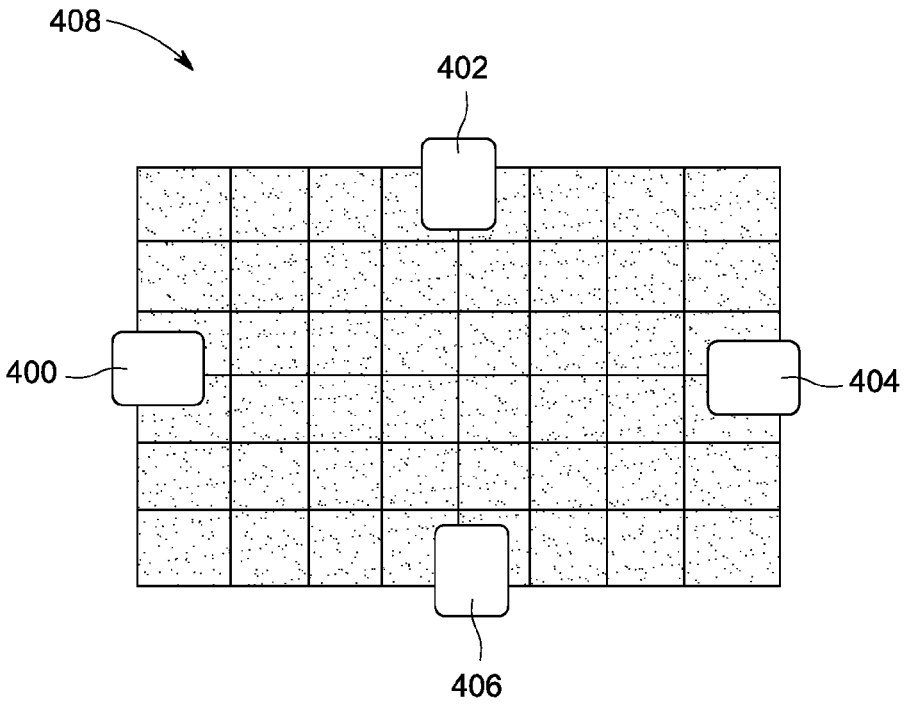
FIG. 5 is a top plan view of a plush bedroom clip kit positioned on top of a comforter in accordance with this disclosure.
Figure 6:
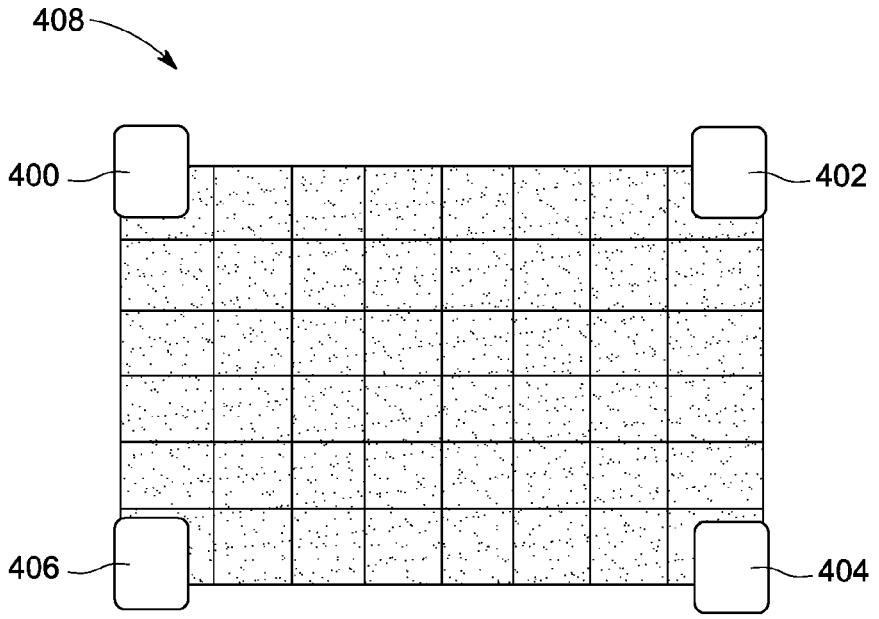
FIG. 6 is a top plan view of a plush bedroom clip kit positioned on top of a comforter in accordance with this disclosure.

Referring to FIGS. 5-6 with continuing reference to the foregoing figures, additional configurations of plush bedroom clips 400-406 positioned on a stack of layers 408 of bedding cover materials is shown. In FIG. 5, each plush bedroom clip 400-406 is positioned in the middle of the side of the stack 408. In FIG. 6, each plush bedroom clip 400-406 is positioned on each corner of the stack 408.

Figure 7:
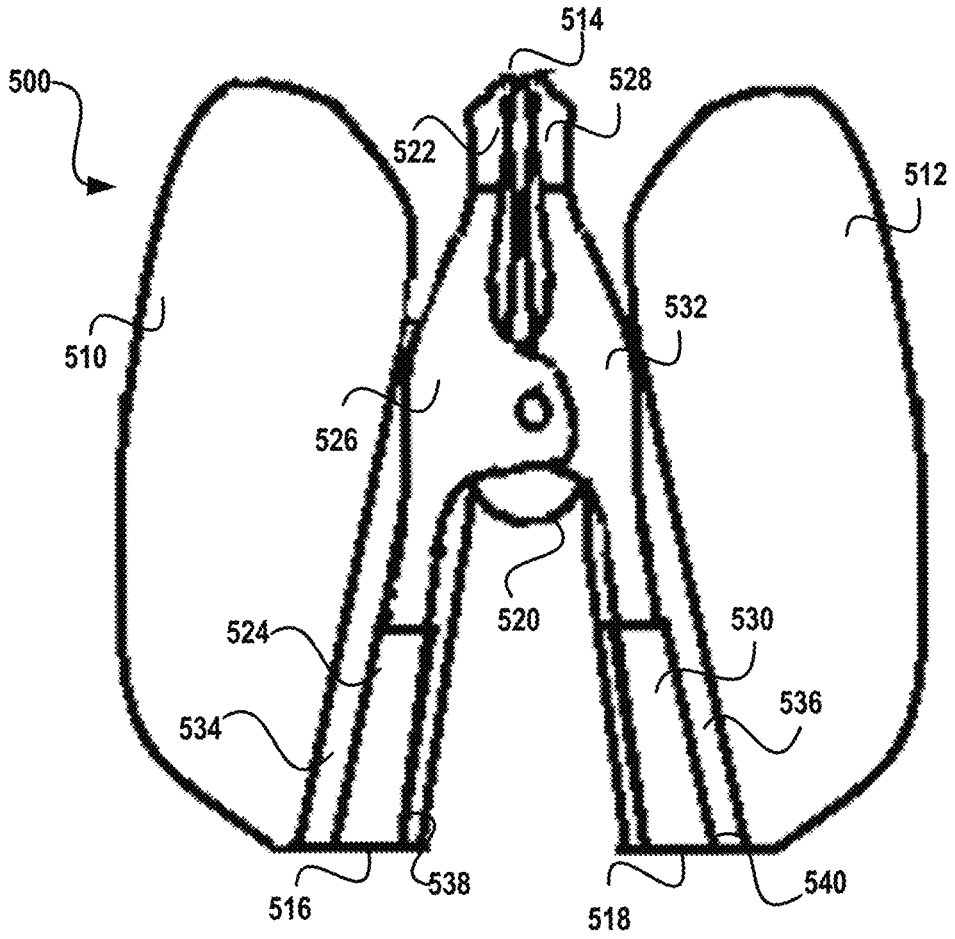
FIG. 7 is a side elevation view of a cross section of another embodiment of a plush bedroom clip in accordance with this disclosure.

Referring now to FIG. 7 with continuing reference to the foregoing figures, there is shown another embodiment of a plush bedroom clip, generally designated by the numeral 500. Like the embodiment shown in FIGS. 1-2, the plush bedroom clip 500 includes a pair of plush cushions 510-512 that are connected by a clamping device 514 that includes a pair of members 516-518 connected to a biasing element assembly 520.

The first member 516 includes a first gripping region 522, a first handle region 524, and a first flange 526 connecting the first gripping region 522 to the first handle region 524. The second member 518 includes a second gripping region 528, a second handle region 530, and a second flange 532 connecting the second gripping region 528 to the second handle region 530.

Unlike the embodiment shown in FIGS. 1-2, the plush bedroom clip 500 includes a pair of tubular frame assemblies 534, 536. The first tubular frame assembly 534 connects to the first cushion 510 through conventional connection means, such as through sewing. Similarly, the second tubular frame assembly 536 connects to the second cushion 512 through conventional connection means, such as through sewing. Each of the tubular frame assemblies 534, 536 can form a chassis.

Each tubular frame assembly 534, 536 defines a slot 538, 540 for receiving the members 516, 518. The first member 516 inserts into the first slot 538, so that the first tubular frame assembly 534 surrounds the first handle region 524, at least partially, to connect the first member 516 to the first cushion 510. Similarly, the second member 518 inserts into the second slot 540, so that the second tubular frame assembly 536 surrounds the second handle region 532, at least partially, to connect the second member 518 to the second cushion 512. The tubular frame assemblies 534, 536 can be made from any suitable materials, including metals, ceramics, polymers, plastics or composites, through any suitable manufacturing process. The plastics can include plastic materials, such as thermosets, thermoplastics, thermoplastic elastomers, elastomers, rubbers, network polymer materials, and plastic composite materials. In this exemplary embodiment, the tubular frame assemblies 534-536 are made from plastics and, in particular, rubber.

Figure 8:
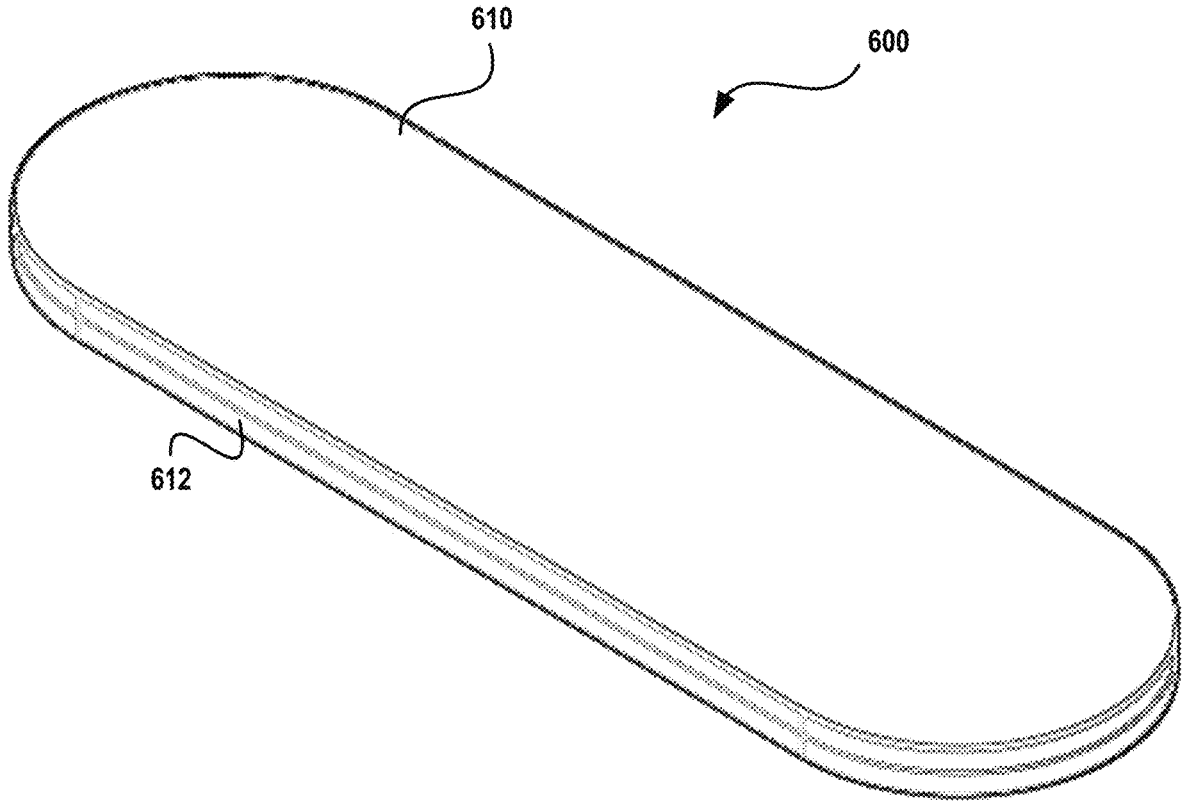
FIG. 8 is another perspective view of a plush bedroom clip in accordance with this disclosure.
Figure 9:
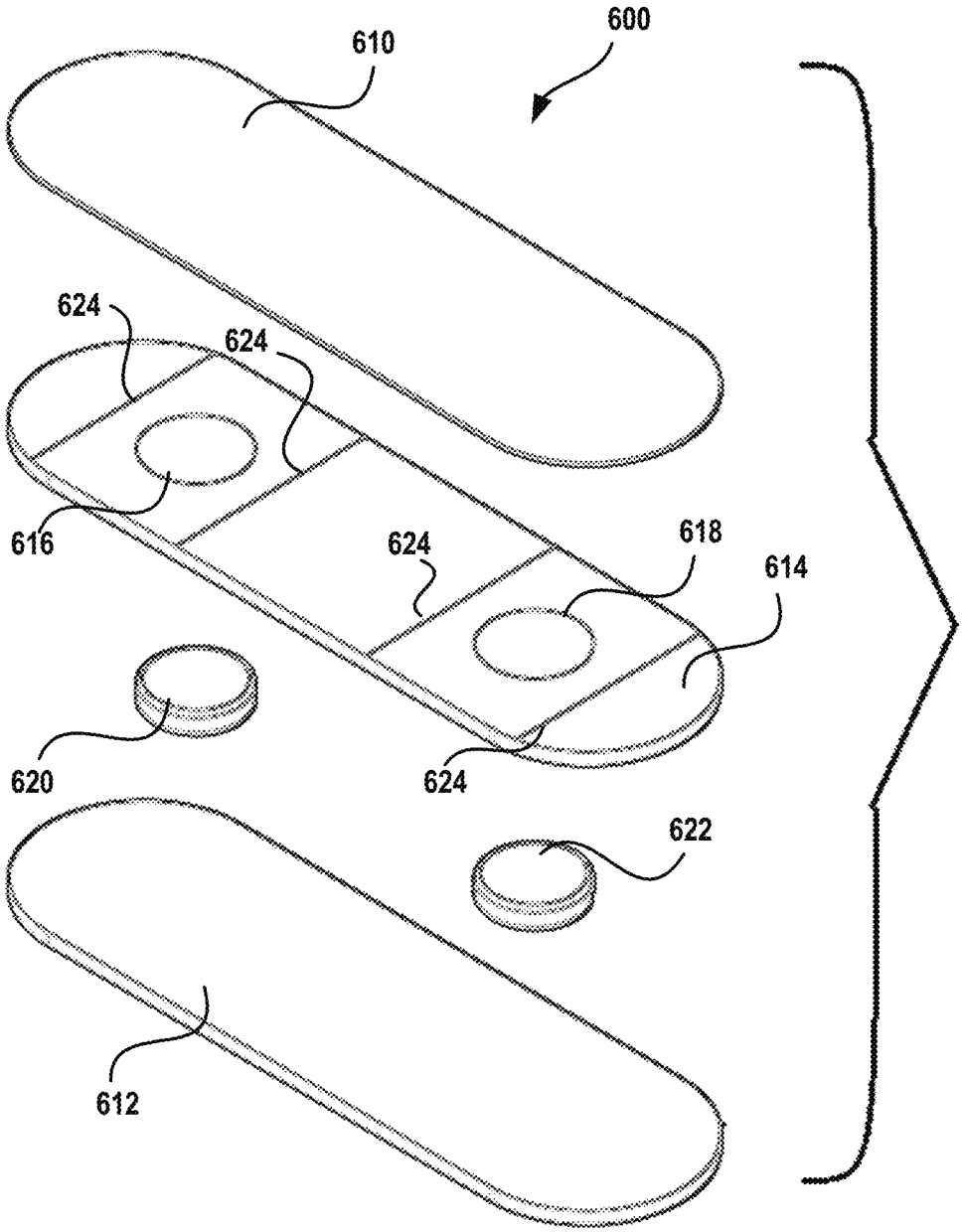
FIG. 9 is an exploded perspective view of the plush bedroom clip shown in FIG. 8 in accordance with this disclosure.

Referring now to FIGS. 8-9, there is shown another embodiment of a plush bedroom clip, generally designated by the numeral 600, which is particularly adapted to grip and to hold a plurality of layers of bedding cover materials (not shown). The plush bedroom clip 600 is an essentially layered construction having an outer layer comprised of a pair of covers 610-612 and interior layer comprised of an essentially flat, flexible elongated member 614.

The member 614 is positioned between the covers 610-612. The member 614 includes a pair of spaced-apart bores 616-618 with the covers 610-612 essentially enclosing the member 614. A magnet 620 is positioned in the bore 616. A magnetizable material 622 is positioned in the bore 618. The member 614 includes a plurality of sew lines 624, but the covers 610-612 do not include any sew lines, unless the covers 610-612 include trim (not shown).

The member 614 is movable from an essentially flat configuration to an essentially U-shaped folded configuration. In the U-shaped configuration the magnet 620 attracts the magnetizable material 622 with sufficient force to form a clamp. In the U-shaped configuration, the clamp 600 can grip layers of bedding cover materials, such as sheets, blankets, comforters, duvets, and other similar objects.

The covers 610-612 can be made from any suitable flexible foldable, collapsible, or otherwise malleable material. In some embodiments, the covers 610-612 are made from plush fabric materials or from plastic materials. Optionally, the flexible material can be jersey cotton.

The covers 610-612 can be joined to one another through any suitable method to enclose the member 614, including sewing.

The member 614 can be made from any suitable flexible material. Suitable materials include plastics and resilient materials. The member 614 can be made from neoprene with bare rubber on the bottom.

The magnet 620 and the magnetizable material 622 can be made from any suitable material that is capable of being magnetized. In some embodiments, the magnetizable material 622 can be another magnet and, optionally, can be identical to the magnet 620. The bores 616, 618, the magnet 620, and the magnetizable material 622 can be essentially cylindrical. The magnet 620 and the magnetizable material 622 can be neodymium magnets.

Figure 10:
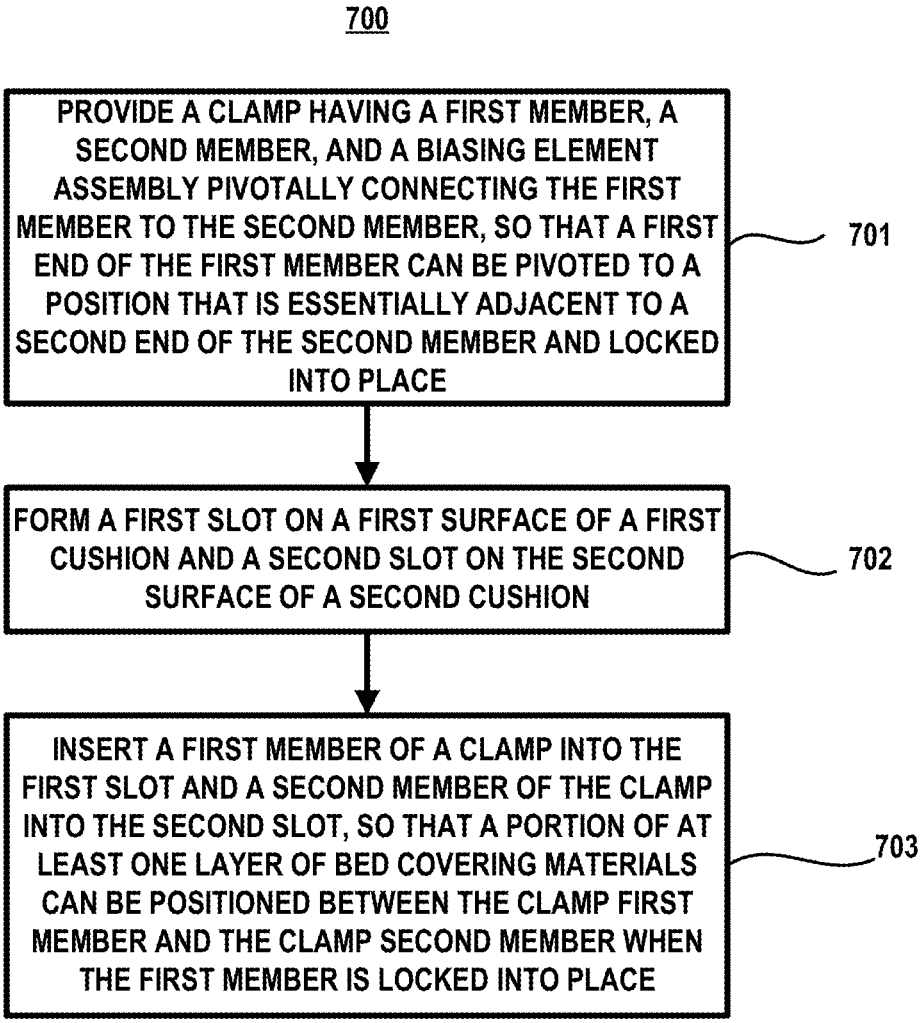
FIG. 10 illustrates an exemplary process in accordance with this disclosure.

Referring to FIG. 10 with continuing reference to the foregoing figures, a method 700 of using a plush bedroom clip in accordance with the described subject matter is shown. Method 700, or portions thereof, can be performed using the plush bedroom clip 100 shown in FIGS. 1-2, the plush bedroom clip 238 shown in FIG. 3, the plush bedroom clips 314, 316 shown in FIG. 4 and/or the plush bedroom clips 400-406 shown in FIGS. 5-6.

At 701, a clamp having a first member, a second member, and a biasing element assembly pivotally connecting the first member to the second member is provided, so that a first end of the first member can be pivoted to a position that is essentially adjacent to a second end of the second member and locked into place. In this exemplary embodiment, the clamp can be the clamping device 114 shown in FIGS. 1-2.

At 702, a first slot is formed on a first surface of a first cushion and a second slot is formed on the second surface of a second cushion. In this exemplary embodiment, the first cushion can be the cushion 110 shown in FIGS. 1-2 and the second cushion can be cushion 112 shown in FIGS. 1-2.

At 703, a first member of a clamp is inserted into the first slot and a second member of the clamp is inserted into the second slot, so that a portion of at least one layer of bed covering materials can be positioned between the clamp first member and the clamp second member when the first member is locked into place.

Figure 11:
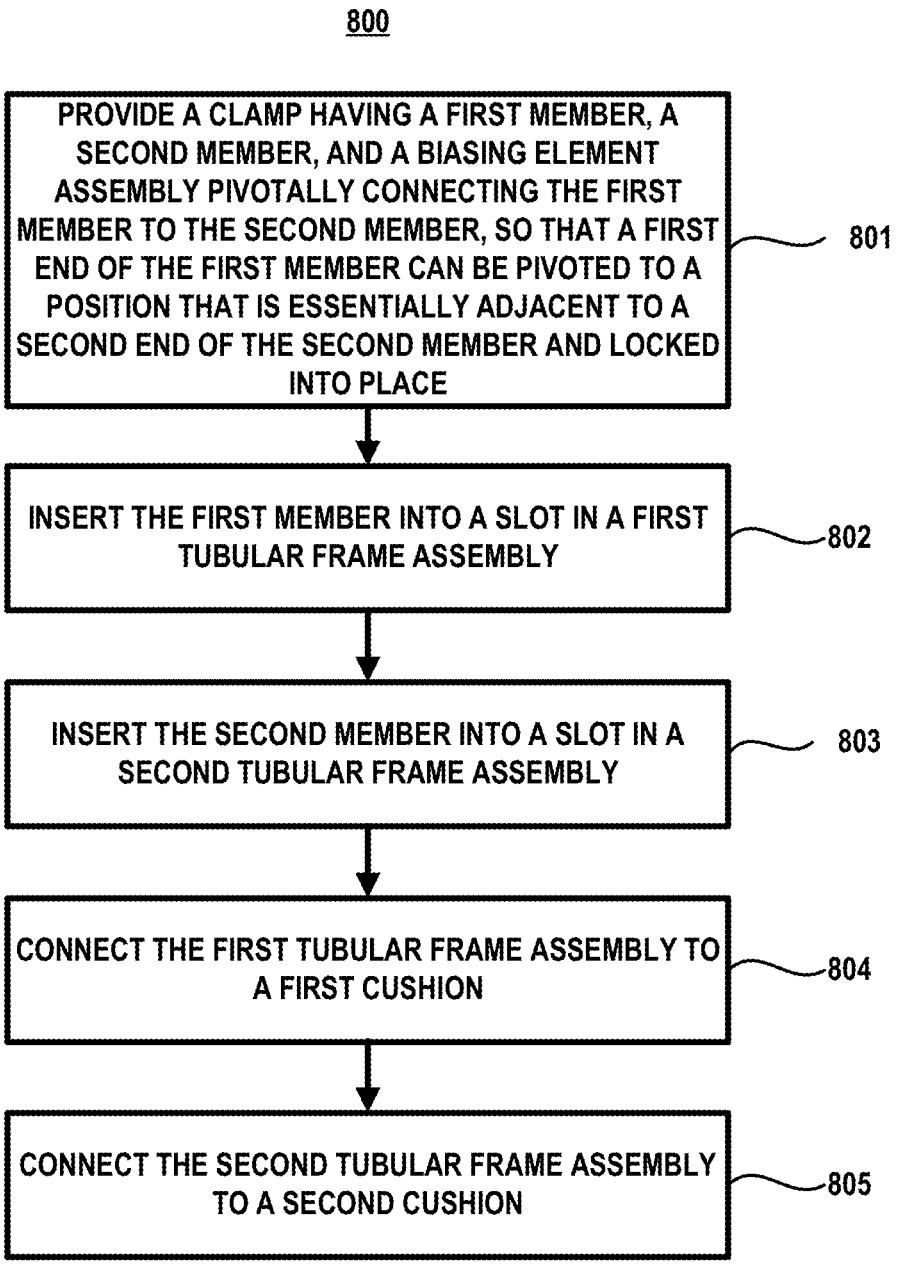
FIG. 11 illustrates another exemplary process in accordance with this disclosure.

Referring to FIG. 11 with continuing reference to the foregoing figures, a method 800 of assembling a plush bedroom clip in accordance with the described subject matter is shown. Method 800, or portions thereof, can be performed using the plush bedroom clip 500 shown in FIG. 7.

At 801, a clamp having a first member, a second member, and a biasing element assembly pivotally connecting the first member to the second member is provided, so that a first end of the first member can be pivoted to a position that is essentially adjacent to a second end of the second member and locked into place. In this exemplary embodiment, the clamp can be the clamping device 514 shown in FIG. 7.

At 802, the first member is inserted into a first slot in a first frame assembly. In this exemplary embodiment, the first tubular frame assembly can be the first tubular frame assembly 534 shown in FIG. 7.

At 803, the second member is inserted into a second slot in a second tubular frame assembly. In this exemplary embodiment, the second tubular frame assembly can be the second tubular frame assembly 536 shown in FIG. 7.

At 804, the first tubular frame assembly is connected to a first cushion. In this exemplary embodiment, the first cushion can be the first cushion 510 shown in FIG. 7.

At 805, the second tubular frame assembly is connected to a second cushion. In this exemplary embodiment, the second cushion can be second cushion 512 shown in FIG. 7.

SUPPORTED FEATURES AND EMBODIMENTS

The detailed description provided above in connection with the appended drawings explicitly describes and supports various features of a plush bedroom clip. By way of illustration and not limitation, supported embodiments include a plush bedroom clip comprising: a clamp comprising: a first member including a first gripping region and a first handle region, a second member including a second gripping region and a second handle region, and a biasing element to bias the first gripping region of the first member against the second gripping region of the second member to lock the first member against the second member, and a first cushion having an first upper surface and a first lower surface with the first lower surface having a first slot therein, wherein the first member first gripping region inserts into the first slot to connect the first cushion to the clamp.

Supported embodiments include the foregoing plush bedroom clip, wherein the first member first handle region is inserted through the first slot for positioning within the first cushion.

Supported embodiments include any of the foregoing plush bedroom clips, further comprising a second cushion with a second slot with the second member second gripping region inserting into the second slot to connect the second cushion to the clamp.

Supported embodiments include any of the foregoing plush bedroom clips, wherein the second member second handle region is inserted through the second slot for positioning within the second cushion.

Supported embodiments include any of the foregoing plush bedroom clips, wherein the first member first handle region is inserted through the first slot for positioning within the first cushion.

Supported embodiments include any of the foregoing plush bedroom clips, wherein the first member, the second member, and the biasing element form an A-shaped clamp.

Supported embodiments include any of the foregoing plush bedroom clips, wherein the first member, the second member, and the biasing element include metal.

Supported embodiments include any of the foregoing plush bedroom clips, wherein the first cushion and the second cushion include plush flexible fabric material and a filler material.

Supported embodiments include any of the foregoing plush bedroom clips, wherein the biasing element includes a spring.

Supported embodiments include any of the foregoing plush bedroom clips, wherein the first slot is sewn shut around the first member and the second slot is sewn shut around the second member.

Supported embodiments include a system, a method, an apparatus, and/or means for implementing any of the foregoing plush bedroom clips or a portion thereof.

Supported embodiments include a method of using a plush bedroom clip, the method comprising: providing a clamp having a first member, a second member, and a biasing element assembly pivotally connecting the first member to the second member, so that a first end of the first member can be pivoted to a position that is essentially adjacent to a second end of the second member and locked into place, forming a first slot on a first surface of a first cushion and a second slot on the second surface of a second cushion, inserting a first member of a clamp into the first slot and a second member of the clamp into the second slot, so that a portion of at least one layer of bed covering materials can be positioned between the clamp first member and the clamp second member when the first member is locked into place.

Supported embodiments include the foregoing method, wherein the first member includes a third end and the second member includes a fourth end, the method further comprising: inserting the first end and the third end of the first member into the first slot and the second end and the fourth end of the second member into the second slot, so that essentially all of the first member is positioned within the first cushion and essentially all of the second member is positioned within the second cushion.

Supported embodiments include any of the foregoing methods, wherein the first member, the second member, and the biasing element form an A-shaped clamp.

Supported embodiments include any of the foregoing methods, wherein the biasing element includes a spring.

Supported embodiments include any of the foregoing methods, further comprising: surrounding a portion of the first member with a first tubular frame assembly to connect the first member to the first cushion, and surrounding a portion of the second member with a second tubular frame assembly to connect the second member to the second cushion.

Supported embodiments include any of the foregoing methods, further comprising: closing the first slot around the first member to enclose a portion of the first member in the first cushion, and closing the second slot around the second member to enclose a portion of the second member in the second cushion.

Supported embodiments include any of the foregoing methods, wherein the closing steps are performed by sewing.

Supported embodiments include a system, an apparatus, and/or means for implementing any of the foregoing methods or a portion thereof.

Supported embodiments include a kit for clipping layers of bed covering materials, the kit comprising: a plurality of bedroom clips with each clip including a clamp having a first member, a second member, and a biasing element pivotally connecting the first member to the second member and locking the first member against the second member to grip the layers of bed covering materials, a first cushion for enclosing the first member, at least partially, and a second cushion for enclosing the second member, at least partially, and a plurality of straps for connecting the plurality of bedroom clips to one another.

Supported embodiments include the foregoing kit, wherein the first member includes a first tubular frame assembly for attaching to the first cushion and the second member includes a second tubular frame assembly for attaching to the second cushion.

Supported embodiments include a system, an apparatus, a method and/or means for implementing any of the foregoing kits or a portion thereof.

Supported embodiments include a plush bedroom clip comprising: a clamp comprising: a first member including a first gripping region and a first handle region, a second member including a second gripping region and a second handle region, and a biasing element to bias the first gripping region of the first member against the second gripping region of the second member to lock the first member against the second member, a first tubular frame assembly that surrounds the first member handle region, and a first cushion having an upper surface and a lower surface with the lower surface having a first slot therein, wherein the first member first gripping region inserts into the first tubular frame assembly to connect the first cushion to the clamp.

Supported embodiments include the foregoing plush bedroom clip, further comprising: a second cushion, and a second tubular frame assembly, wherein the second member inserts into the second tubular frame assembly, so that the second tubular frame assembly surrounds the second member handle region to connect the second member to the second cushion.

Supported embodiments include any of the foregoing plush bedroom clips, wherein the first tubular frame assembly and the second tubular frame assembly are made from a plastic material.

Supported embodiments include any of the foregoing plush bedroom clips, wherein the plastic material is selected from the group consisting of a thermoset, a thermoplastic, a thermoplastic elastomer, an elastomer, a rubber, a network polymer material, and a plastic composite material.

Supported embodiments include a system, a method, an apparatus, and/or means for implementing any of the foregoing plush bedroom clips or a portion thereof.

Supported embodiments include a system, a method, an apparatus, and/or means for implementing any of the foregoing plush bedroom clips or a portion thereof.

Supported embodiments include a plush bedroom clip system for use in a bed having a frame, a headboard, at least one pillow, and a plurality of layers of bed covering materials, the plush bedroom clip system comprising: a plush bedroom clip comprising: a clamp having a first member including a first gripping region and a first handle region, a second member including a second gripping region and a second handle region, and a biasing element to bias the first gripping region of the first member against the second gripping region of the second member to lock the first member against the second member, a first cushion having an first upper surface and a first lower surface with the lower surface having a first slot therein with the first member first gripping region inserting into the first slot to connect the first cushion to the clamp, and a second cushion with a second slot with the second member second gripping region inserting into the second slot to connect the second cushion to the clamp, wherein the plush bedroom clip is positioned on the bed.

Supported embodiments include the foregoing plush bedroom clip system, wherein the plush bedroom clip grips the plurality of layers of bed covering materials between the first cushion and the second cushion.

Supported embodiments include any of the foregoing plush bedroom clip systems, wherein the plush bedroom clip grips the plurality of layers of bed covering materials to allow a person sleeping under the bed covering materials to move with a free range of motion thereunder.

Supported embodiments include any of the foregoing plush bedroom clip systems, wherein the plush bedroom clip attaches the plurality of layers of bedding cover materials to the headboard.

Supported embodiments include any of the foregoing plush bedroom clip systems, wherein the plush bedroom clip attaches the plurality of layers of bedding cover materials to the pillow.

Supported embodiments include any of the foregoing plush bedroom clip systems, further comprising: a plurality of bedroom clips with each bedroom clip being identical to the plush bedroom clip.

Supported embodiments include any of the foregoing plush bedroom clip systems, further comprising: a strap for connecting at least one of the plurality of bedroom clips to another one of the plurality of bedroom clips.

Supported embodiments include any of the foregoing plush bedroom clip systems, wherein the bed has four corners and at least one of the plurality of bedroom clips is positioned at each one of the four corners.

Supported embodiments include any of the foregoing plush bedroom clip systems, wherein the bed has a pair of sides with each side having a midpoint and at least one of the plurality of bedroom clips is positioned at each midpoint.

Supported embodiments include a method, an apparatus, and/or means for implementing any of the foregoing systems or a portion thereof.

Supported embodiments include a plush bedroom clip comprising: a pair of flexible covers, an essentially flat, flexible member positioned between the pair of flexible covers having a pair of spaced-apart bores with the pair of flexible covers essentially enclosing the essentially flat, flexible member, a magnet positioned in one of the pair of spaced-apart bores, and a magnetizable material positioned in the other one of the pair of spaced-apart bores, wherein the essentially flat, flexible member is movable from an essentially flat configuration to an essentially U-shaped folded configuration with the magnet attracting the magnetizable material to form a clamp.

Supported embodiments include the foregoing plush bedroom clip, wherein the pair of flexible covers is formed from plush fabric materials.

Supported embodiments include any of the foregoing plush bedroom clips, wherein the flat, flexible member is formed from a plastic material.

Supported embodiments include any of the foregoing plush bedroom clips, wherein the flat, flexible member is formed from a resilient material.

Supported embodiments include any of the foregoing plush bedroom clips, wherein the pair of flexible covers are sewn together.

Supported embodiments include any of the foregoing plush bedroom clips, wherein the magnetizable material is a magnet.

Supported embodiments include any of the foregoing plush bedroom clips, wherein the pair of spaced-apart bores, the magnet, and the magnetizable material are essentially cylindrical.

Supported embodiments include a system, a method, an apparatus, and/or means for implementing any of the foregoing plush bedroom clips or a portion thereof.

Supported embodiments can provide various attendant and/or technical advantages in terms of holding together multiple layers of bedding cover materials to prevent them from become tangled. Such advantages can include bundling layers of bedding cover materials to make it easier to prepare the layer of bedding cover materials for washing.

Supported embodiments are made from materials having predetermined colors, textures, etc. that match the aesthetics of the bedding cover materials while securing the materials.

Supported embodiments include plush bedroom clips that maintain comfortability for the user in the event that they roll over on the plush bedroom clips or otherwise contact the plush bedroom clips during sleep.

Supported embodiments include plush bedroom clips that float freely with a sleeper as the sleeper tosses or turns in bed. Such plush bedroom clips are intended for use with multiple layers of bedding cover materials, such as sheets, blankets, comforters, duvets, and other similar objects. The plush bedroom clips can have varying dimensions, but, in some embodiments, can have preselected dimensions to grip up to five to ten layers of thick bedding cover materials.

Supported embodiments include a plush bedroom clip that can clip pillows in place or that can clip bedding cover materials or pillows to a bed headboard. Such plush bedroom clips can be arranged to fold down bedding cover materials, to clip corners, to grip bed sides, or to secure a folded down comforter or sheet in place.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A plush bedroom clip comprising:

a pair of flexible covers, an essentially flat, flexible member positioned between the pair of flexible covers having a pair of spaced-apart bores with the pair of flexible covers essentially enclosing the essentially flat, flexible member, a magnet positioned in one of the pair of spaced-apart bores, and a magnetizable material positioned in the other one of the pair of spaced-apart bores, wherein the essentially flat, flexible member is movable from an essentially flat configuration to an essentially U-shaped folded configuration with the magnet attracting the magnetizable material to form a clamp.

2. The plush bedroom clip of claim 1, wherein the pair of flexible covers is formed from plush fabric materials.

3. The plush bedroom clip of claim 2, wherein the flat, flexible member is formed from a plastic material.

4. The plush bedroom clip of claim 3, wherein the flat, flexible member is formed from a resilient material.

5. The plush bedroom clip of claim 2, wherein the pair of flexible covers are sewn together.

6. The plush bedroom clip of claim 2, wherein the magnetizable material is a magnet.

7. The plush bedroom clip of claim 2, wherein the pair of spaced-apart bores, the magnet, and the magnetizable material are essentially cylindrical.

8. A kit comprising:

a pair of flexible covers, an essentially flat, flexible member for positioning between the pair of flexible covers having a pair of spaced-apart bores with the pair of flexible covers having the ability to essentially enclose the essentially flat, flexible member, a magnet for positioning in one of the pair of spaced-apart bores, and a magnetizable material for positioning in the other one of the pair of spaced-apart bores, wherein the essentially flat, flexible member is movable from an essentially flat configuration to an essentially U-shaped folded configuration, and wherein the magnet can attract the magnetizable material to form a clamp.

9. The kit of claim 8, wherein the pair of flexible covers is formed from plush fabric materials.

10. The kit of claim 8, wherein the flat, flexible member is formed from a plastic material.

11. The kit of claim 10, wherein the flat, flexible member is formed from a resilient material.

12. The kit of claim 8, wherein the pair of flexible covers are sewn together.

13. The kit of claim 8, wherein the magnetizable material is a magnet.

14. The kit of claim 8, wherein the pair of spaced-apart bores, the magnet, and the magnetizable material are essentially cylindrical.

15. A plush bedroom clip system for use in a bed having a frame, a headboard, at least one pillow, and plurality of layers of bed covering materials, the plush bedroom clip system comprising:

a plush bedroom clip comprising:

a pair of flexible covers, an essentially flat, flexible member positioned between the pair of flexible covers having a pair of spaced-apart bores with the pair of flexible covers essentially enclosing the essentially flat, flexible member, a magnet positioned in one of the pair of spaced-apart bores, and a magnetizable material positioned in the other one of the pair of spaced-apart bores, wherein the essentially flat, flexible member is movable from an essentially flat configuration to an essentially U-shaped folded configuration with the magnet attracting the magnetizable material to form a clamp, and wherein the plush bedroom clip is positioned on the bed.

16. The plush bedroom clip system of claim 15, wherein the plush bedroom clip grips the plurality of layers of bed covering materials between the first cushion and the second cushion.

17. The plush bedroom clip system of claim 15, wherein the plush bedroom clip grips the plurality of layers of bed covering materials to allow a person sleeping under the bed covering materials to move with a free range of motion thereunder.

18. The plush bedroom clip system of claim 15, wherein the plush bedroom clip attaches the plurality of layers of bedding cover materials to the headboard.

19. The plush bedroom clip system of claim 15, wherein the plush bedroom clip attaches the plurality of layers of bedding cover materials to the pillow.

20. The plush bedroom clip system of claim 15, further comprising:

a plurality of bedroom clips with each bedroom clip being identical to the plush bedroom clip.

* * * * *